US011846180B2

(12) United States Patent
Al-Qasim et al.

(10) Patent No.: US 11,846,180 B2
(45) Date of Patent: Dec. 19, 2023

(54) DIAMONDOIDS FOR MONITORING AND SURVEILLANCE

(71) Applicant: SAUDI ARABIAN OIL COMPANY, Dhahran (SA)

(72) Inventors: Abdulaziz S. Al-Qasim, Dammam (SA); Yuguo Wang, Dhahran (SA); Mohamed Nabil Noui-Mehidi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 282 days.

(21) Appl. No.: 17/192,322

(22) Filed: Mar. 4, 2021

(65) Prior Publication Data

US 2022/0282614 A1 Sep. 8, 2022

(51) Int. Cl.
*E21B 47/113* (2012.01)
*E21B 49/00* (2006.01)
*E21B 47/12* (2012.01)

(52) U.S. Cl.
CPC ..... *E21B 47/114* (2020.05); *E21B 47/12* (2013.01); *E21B 49/008* (2013.01)

(58) Field of Classification Search
CPC ..... E21B 47/114; E21B 47/12; E21B 49/008
See application file for complete search history.

(56) References Cited

U.S. PATENT DOCUMENTS

2007/0113676 A1 5/2007 Sale et al.
2010/0006750 A1 1/2010 Zahlsen et al.
(Continued)

FOREIGN PATENT DOCUMENTS

EP 0816631 B1 6/2005
WO 2001081914 A1 11/2001
(Continued)

OTHER PUBLICATIONS

Liang et al., "Quantitative analysis of diamondoids in crude oils using gas chromatography-triple quadrupole mass spectrometry"), 2011. (Year: 2011).*
(Continued)

*Primary Examiner* — Andrew Schechter
*Assistant Examiner* — Jeremy A Delozier
(74) *Attorney, Agent, or Firm* — Osha Bergman Watanabe & Burton LLP

(57) ABSTRACT

A downhole monitoring system for continuously measuring in real-time a fluid produced from a reservoir includes a tubing extending into a wellbore, spaced apart packers forming annular seals between the tubing and a wall of the wellbore, isolated compartments formed between the spaced apart packers, each compartment having an opening in the tubing to allow fluid communication from the reservoir to surface equipment, and an ultraviolet spectrometer installed in each compartment. The ultraviolet spectrometer includes an ultra-violet source that excites diamondoids, a photomultiplier to quantify the excited diamondoids, and an electronic circuit that digitizes a response from the photomultiplier and sends the response to the surface of the wellbore. Additionally, a method includes continuously monitoring and in real-time a fluid produced from a reservoir and determining reservoir connectivity and reservoir profiling.

17 Claims, 9 Drawing Sheets

(56) References Cited

U.S. PATENT DOCUMENTS

| | | | | |
|---|---|---|---|---|
| 2010/0044110 | A1 | 2/2010 | Bangru et al. | |
| 2012/0325464 | A1 | 12/2012 | Kilaas | |
| 2013/0240205 | A1* | 9/2013 | Tosi | G01V 3/30 166/250.01 |
| 2015/0136962 | A1* | 5/2015 | Pomerantz | G01N 21/64 250/255 |
| 2015/0138337 | A1* | 5/2015 | Tjhang | E21B 43/35 166/305.1 |
| 2016/0010454 | A1 | 1/2016 | Sira et al. | |

FOREIGN PATENT DOCUMENTS

| | | | |
|---|---|---|---|
| WO | 2009006178 | A1 | 1/2009 |
| WO | 2010096039 | A1 | 8/2010 |
| WO | 2019232043 | A1 | 12/2019 |

OTHER PUBLICATIONS

Atkins, Peter et al., "Atomic structure", Shriver & Atkins' Inorganic Chemistry, W.H. Freeman Company, 5th Ed., pp. 3-33 (31 pages).
Atkins, Peter et al., "Molecular structure and bonding", Shriver & Atkins' Inorganic Chemistry, W.H. Freeman Company, 5th Ed., pp. 34-64 (31 pages).
Atkins, Peter et al., "Oxidation and reduction", Shriver & Atkins' Inorganic Chemistry, W.H. Freeman Company, 5th Ed., pp. 147-178 (32 pages).
Atkins, Peter et al., "Physical techniques in inorganic chemistry", Shriver & Atkins' Inorganic Chemistry, W.H. Freeman Company, 5th Ed., pp. 223-254 (32 pages).
Atwah, Ibrahim et al., "Diamondoids in Tracing Petroleum Systems: Case Studies from the Unconventional Reservoirs of North America", IPTC-19748-ABSTRACT, International Petroleum Technology Conference, Jan. 2020, pp. 1-6 (6 pages).
Chan, Yik Chung et al., "Solubility of Diamantane, Trimantane, Tetramantane, and Their Derivatives in Organic Solvents", Journal of Chemical & Engineering Data, American Chemical Society, vol. 53, No. 8, Jul. 2008, pp. 1767-1771 (5 pages).
Dahl, Jeremy E.P. et al., "Determination of Thermal Maturity and the Extent of Oil Cracking in Tight Shales Using Extract Biomarker and Diamondoid Concentrations and Distributions", SPE 168700 / URTeC 1574980, Unconventional Resources Technology Conference, Aug. 2013, pp. 1-5 (5 pages).
Landa, S. and V. Machácek, "Sur l'adamantane, nouvel hydrocarbure extrait du naphte", Collection of Czechoslovak Chemical Communications, vol. 5, 1933, pp. 1-5 (12 pages).
Ma, Anlai, "Advancement in application of diamondoids on organic geochemistry", Journal of Natural Gas Geoscience, ScienceDirect, Elsevier B.V., vol. 1, Sep. 2016, pp. 257-265 (9 pages).
Mansoori, G Ali et al., "Diamondoids in Petroleum and other Fossil Fuels", Diamondoid Molecules with Applications in Biomedicine, Materials Science, Nanotechnology & Petroleum Science, World Scientific, Nov. 2012, pp. 39-102 (64 pages).
Mansoori, G Ali et al., "Physical Properties of Diamondoids", Diamondoid Molecules with Applications in Biomedicine, Materials Science, Nanotechnology & Petroleum Science, World Scientific, Nov. 2012, pp. 103-184 (82 pages).
Schoell, Martin and Robert M.K. Carlson, "Diamondoids and oil are not forever", Nature, Macmillan Magazines Ltd, vol. 399, May 1999, pp. 15-16 (2 pages).
Smith, Vicky S. and Amyn S. Teja, "Solubilities of Diamondoids in Supercritical Solvents", Journal of Chemical and Engineering Data, American Chemical Society, vol. 41, No. 4, 1996, pp. 923-925 (3 pages).
Springer, M.V. et al., "Diamondoid and biomarker characterization of oils from the Llanos Orientales Basin, Colombia", Organic Chemistry, ScienceDirect, Elsevier Ltd., vol. 41, Mar. 2010, pp. 1013-1018 (6 pages).
Swaid, I. et al., "NIR—Spectroscopic Investigations on Phase Behaviour of Low-Volatile Organic Substances in Supercritical Carbon Dioxide", Fluid Phase Equilibrium, Elsevier Science Publishers B.V., vol. 21, 1985, pp. 95-112 (18 pages).
Yang, C. et al., "GC/MS Quantitation of Diamondoid Compounds in Crude Oils and Petroleum Products", Environmental Forensics, Taylor & Francis, vol. 7, 2006, pp. 377-390 (14 pages).

* cited by examiner

DIAMONDOIDS FOR MONITORING AND SURVEILLANCE

BACKGROUND

Hydrocarbons may be driven from a reservoir to the surface by natural differential pressure between the reservoir and the bottomhole pressure within a wellbore in what may be referred to as a pressure stage of production. After the pressure stage, an artificial lift system such as a sucker rod pump and an electrical submersible pump can be utilized to drive hydrocarbons to the surface. After the artificial lift stage, a flood operation can be utilized to drive hydrocarbons to the surface.

FIG. 1 illustrates an example of a flood operation or flooding from an injection well to two producer wells. A displacing fluid such as water, or gas such as $CO_2$, or surfactant, is injected into the reservoir via one or more injection wells 101, and the displacing fluid displaces or physically sweeps the hydrocarbons towards one or more production wells 102 and 103 to the surface.

During production of hydrocarbons, water may displace the hydrocarbon (e.g., oil), and the oil-water contact level may rise in the reservoir. When the water fraction becomes too high, the production becomes non-profitable. Often production fluids may come from different layers or zones of the formation cut by the well. The individual zones may have different permeability, and thus may behave differently during production. The gathering and analyses of information from the reservoir during production may be referred to as reservoir monitoring or profiling.

A known method of reservoir monitoring includes logging operations, in which the local flow properties in an oil and/or gas producing well may be examined by sending logging tools into the well. Using this technique, it is possible to calculate the amount of fluids flowing into different regions of the well. However, production of oil and/or gas has to be wholly or partially stopped during logging, and cessation of production has a great financial impact on the operator. Additionally, it is difficult to use logging techniques for long horizontal boreholes (2-4 miles) since special equipment is required to insert the logging tool into horizontal wells.

Another known technique in reservoir monitoring is the application of traceable materials or tracers (e.g., radioactive tracers). For example, tracers can be sent downhole with drilling fluids to monitor lost circulation. Tracers can also be used to determine carbon dioxide ($CO_2$) leaks from $CO_2$ sequestration reservoirs. However, direct determination of $CO_2$ leakage from the $CO_2$ sequestration reservoir to the atmosphere is difficult due to the presence of atmospheric $CO_2$.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to downhole monitoring systems for continuously measuring in real-time a fluid produced from a reservoir that include a tubing extending into a wellbore, spaced apart packers forming annular seals between the tubing and a wall of the wellbore, isolated compartments formed between the spaced apart packers, each compartment having an opening in the tubing to allow fluid communication from the reservoir to surface equipment, and an ultraviolet spectrometer installed in each compartment. The ultraviolet spectrometer may include an ultra-violet source that excites diamondoids, a photomultiplier to quantify the excited diamondoids, and an electronic circuit that digitizes a response from the photomultiplier and sends the response to the surface of the wellbore.

In another aspect, embodiments disclosed herein relate to methods for continuously monitoring and in real-time a fluid produced from a reservoir that may include allowing fluid communication from the reservoir to surface equipment through an opening in a plurality of isolated compartments formed along a tubing extended into a wellbore, exciting diamondoids passing by an ultraviolet source in the plurality of isolated compartments, measuring the excited diamondoids in the plurality of isolated compartments; compiling the measurements of the excited diamondoids in each compartment, and determining reservoir connectivity and reservoir profiling based on the response in each compartment.

In yet another aspect, embodiments of the present disclosure relate to methods that may include dissolving deuterated diamondoids in a supercritical state of carbon dioxide $CO_2$, injecting the deuterated diamondoids with $CO_2$ in an injection well, detecting and monitoring a presence of the deuterated diamondoids from at least one of a downhole location in a production well or a surface location of the production well, and determining reservoir connectivity between the injection well and the production well.

Other aspects and advantages of this disclosure will be apparent from the following description made with reference to the accompanying drawings and the appended claims.

DETAILED DESCRIPTION

Embodiments disclosed herein relate to the monitoring and surveillance in real-time of downhole production and the integrity of the completion and surface equipment based on diamondoid markers. According to embodiments of the present disclosure, diamondoids may be sent downhole with production tubing and/or through injection procedures, where the diamondoids may be used to identify selected fluids from the well and perform comprehensive production profiling.

Diamondoids

Figure 1:
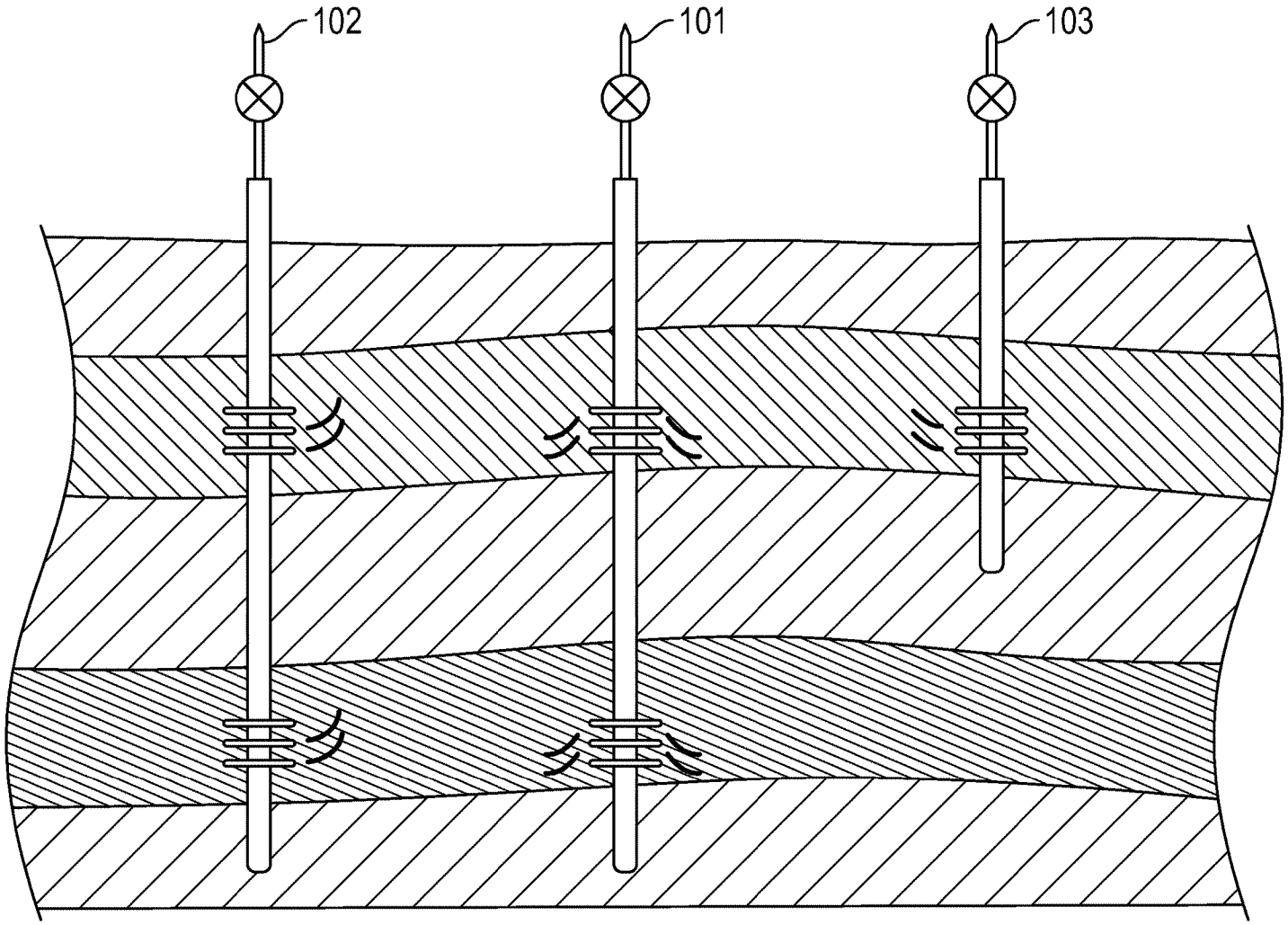
FIG. 1 (Prior Art)
FIG. 1 illustrates a flood operation from an injection well to two production wells.
Figure 2:
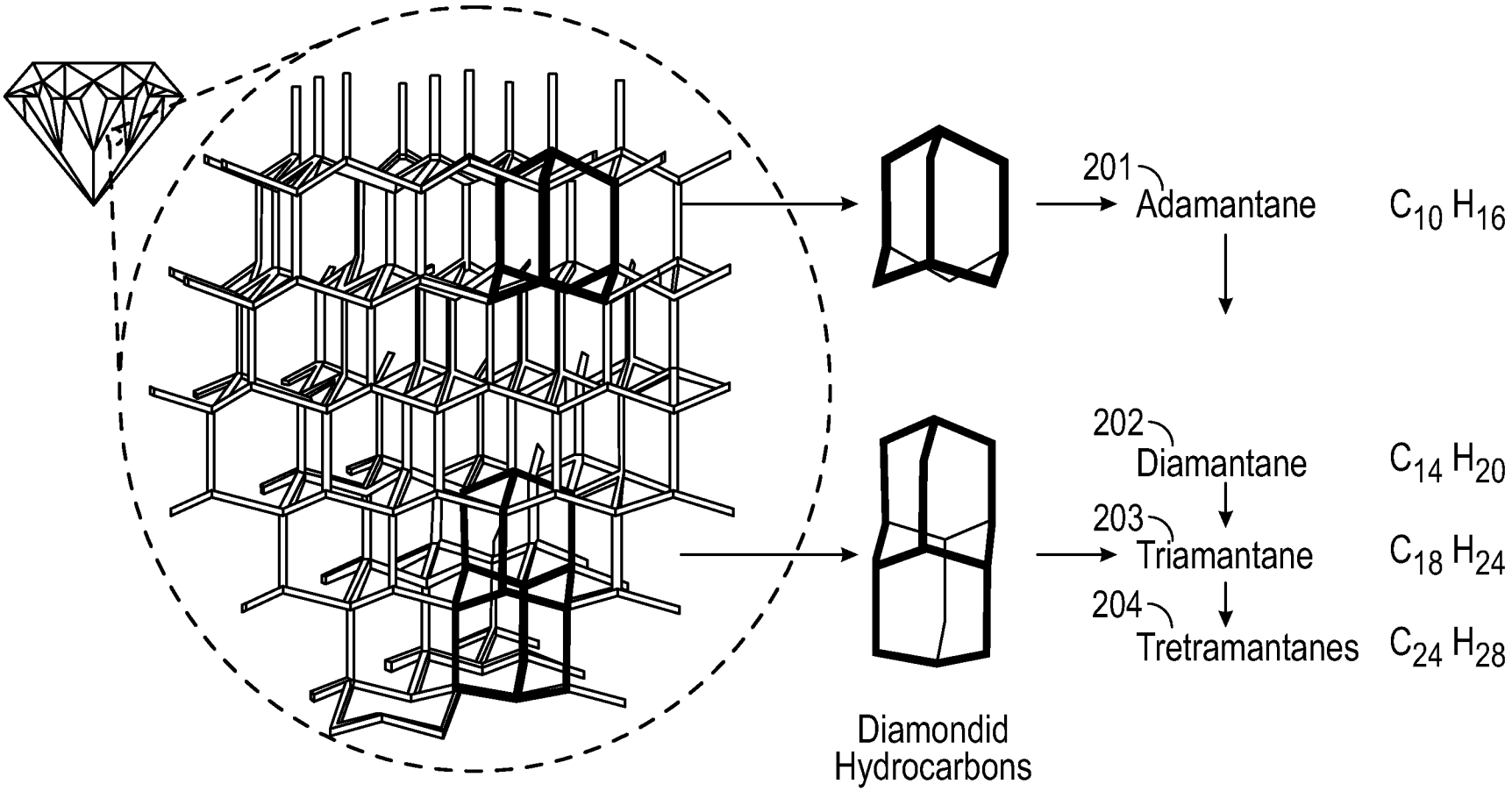
FIG. 2 (Prior Art)
FIG. 2 depicts a diamondoid structure.

Diamondoids, or molecular diamonds, are hydrocarbon compounds having a general molecular formula of $C_{4n+6}H_{4n+12}$ and may naturally occur in crude oils and rock extracts or may be artificially provided. FIG. 2 shows an exemplary diamondoid lattice having a basic repeating unit of adamantane 201 (tricyclo[3, 3, 1, 1, (3,7)]-decane). Adamantane 201 is a four-ring cage system containing 10 carbons, structurally comprising three rigidly fused cyclohexane rings in an "all-chair" (i.e., trans) configuration. The polyhomologous members of adamantanes include diamantanes 202, triamantanes 203, tetramantanes 204, pentamantanes, and hexamantanes, in which adamantanes 201, diamantanes 202, and triamantanes 203 belong to lower diamondoids, and repeated units reaching over 4 (e.g., 4, 5, or 6) belong to higher diamondoids (e.g., polymantanes). Lower diamondoids only contain one isomer, while polymantanes having 4, 5, or 6 repeated units may have 3, 6, and 17 isomers, respectively. When one or more hydrogen atom is replaced by one or more deuterium atom in the diamondoid molecules, they are deuterated (referred to herein as deuterated diamondoids). Diamondoids feature unique thermal stability owing to the cage-like carbon backbone structures. Therefore, unlike classical geochemical compounds, diamondoids may provide robust molecular markers for fingerprinting hydrocarbon fluids at any thermal maturity stage, thereby providing a fluid tracking tool where other marker cannot.

Diamondoids may identify hydrocarbon fluids in different ways, depending on, for example, the amount of diamondoids present in hydrocarbon fluids and/or the type (i.e., chemical structure) of diamondoids present in hydrocarbon fluids. In some embodiments, the biodegradation level of an oil reservoir may be assessed by determining the diamondoid to n-alkane ratio. For example, a higher detected ratio of diamondoids to n-alkane may indicate an increased amount of biodegradation.

Additionally, as diamondoids are more stable at high temperatures than liquid hydrocarbons, diamondoid concentration may increase as reservoir temperature increases due to the cracking of the liquid hydrocarbons. From such relationship, diamondoids can be considered as an "internal standard" by which the extent of cracking in liquid hydrocarbons can be determined.

Diamondoid-sulfur derivatives, such as adamantanethiols for instance, may also be used to predict sour gas content. For example, thermochemical sulfate reduction can form sour $H_2S$ gas reservoirs where a significant concentration of diamondoids containing sulfur, such as adamantanethiols, can be found. Therefore, a comprehensive analysis of diamondoids and their ratios may identify reservoir properties (e.g., connectivity, biodegradation, cracking, and sour gas content) as well as their history.

Figure 3:
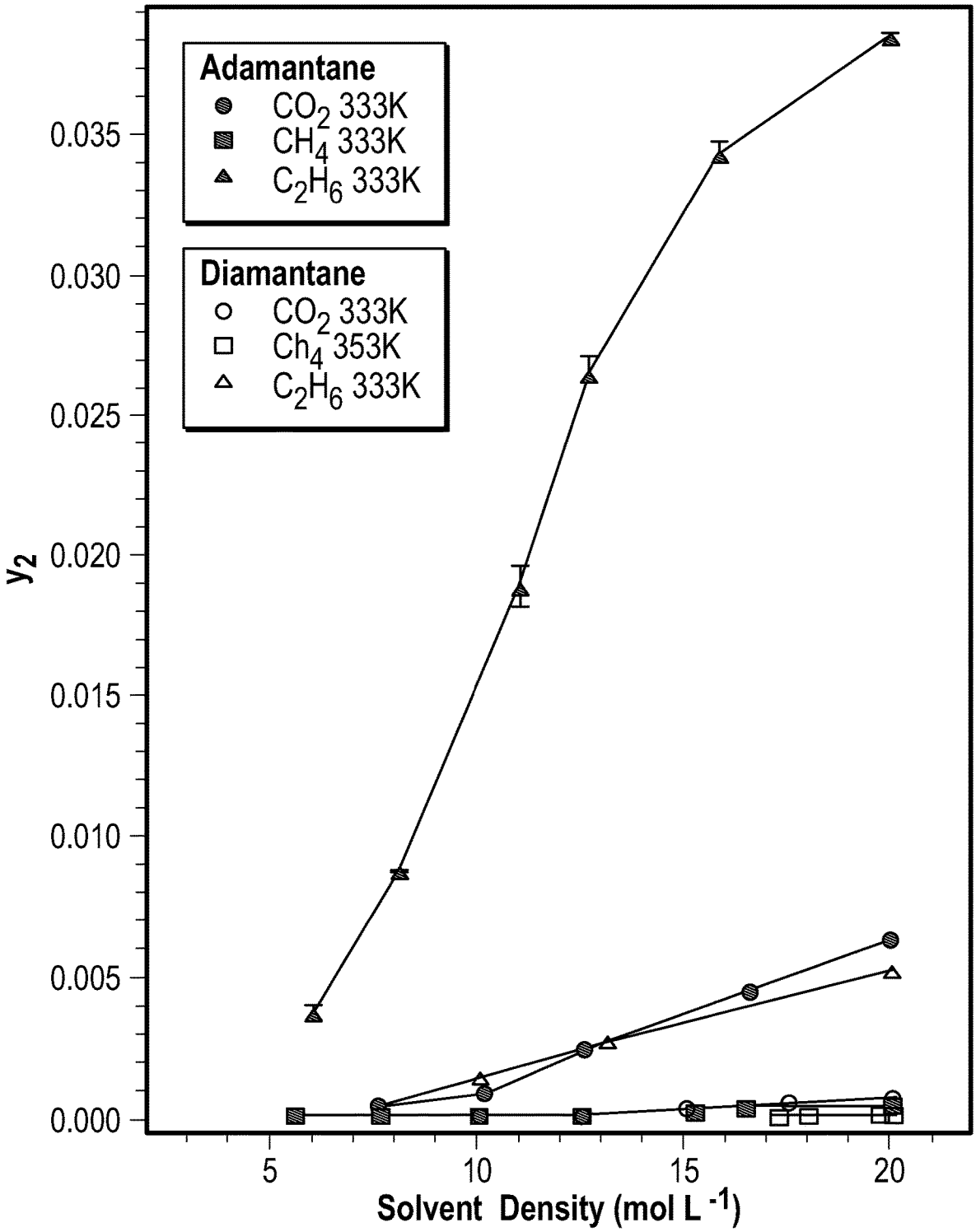
FIG. 3 shows the variation of solubility (in mole fraction) of adamantane and diamantane in $CO_2$, $CH_4$, and $C_2H_6$ as a function of solvent density.

Further, different types of diamondoids have different solubilities in various organic solvents, at different temperatures, and at different pressures (e.g., atmospheric, or high-pressure conditions). For example, FIG. 3 shows the variation of solubility (in mole fraction) of adamantane and diamantine in carbon dioxide ($CO_2$), methane ($CH_4$), and ethane ($C_2H_6$) as a function of solvent density, compiled from Smith, V. S., and Teja, A. S. (1996), "Solubilities of diamondoids in supercritical solvents," Journal of Chemical and Engineering Data 41, 4, pp. 923-925, and Swaid, I., Nickel, D., and Schneider, G. M., "Nir-spectroscopic investigations on phase-behavior of low-volatile organic-substances in supercritical carbon-dioxide," Fluid Phase Equilibria, 1985, 21, 1-2, 95-112. Accordingly, the type of diamondoids used as molecular markers or tracers may be selected based on their solubility with targeted mixing fluids under targeted temperature and pressure conditions. For instance, one type of diamondoid may be selected based on its solubility in gas condensate and insolubility in heavier liquid hydrocarbons, where the selected diamondoid type may be used to trace gas condensate.

Diamondoids may be provided from various sources in a formation and/or in downhole equipment, which may be detected according to embodiments of the present disclosure in order to monitor and/or profile wells. For example, diamondoids may be naturally occurring in a formation and/or diamondoids may be artificially provided downhole, e.g., by injecting the diamondoids into the formation or by providing the diamondoids in downhole equipment. For brevity in distinguishing different sources of diamondoids that may be detected according to embodiments of the present disclosure, diamondoids naturally occurring in a formation may be referred to as naturally occurring diamondoids, diamondoids injected into a well (e.g., injected into an injection well) or injected into a surrounding formation may be referred to as injected diamondoids, and diamondoids that are initially positioned in a downhole compartment formed by downhole components (e.g., prior to forming the compartment in the well) may be referred to as compartment diamondoids. Further, because naturally occurring diamondoids and injected diamondoids may flow through a formation before reaching a compartment in a well, naturally occurring diamondoids and injected diamondoids may also sometimes be referred to as formation diamondoids.

Monitoring Diamondoids Using Downhole Detection Devices

According to embodiments of the present disclosure, diamondoids may be monitored downhole in order to identify one or more types of fluid in a well, where the type and amount of diamondoids detected may be correlated to the type and amount of fluid in the well (e.g., based on one or more identification techniques as discussed above). For instance, when several wells located in the same area produce the same naturally occurring diamondoids with the same ratio between them (giving the same diamondoid "fingerprint"), these wells may be determined to be connected. Based on the determined reservoir profile, an operator may adapt a production program and build a production facility accordingly. Diamondoids may be detected downhole using one or more downhole detection devices, such as an ultraviolet spectrometer. Further, diamondoid detection according to embodiments of the present disclosure may be used in a downhole monitoring and surveillance system for continuously measuring in real-time a fluid produced from a reservoir.

Figure 4:
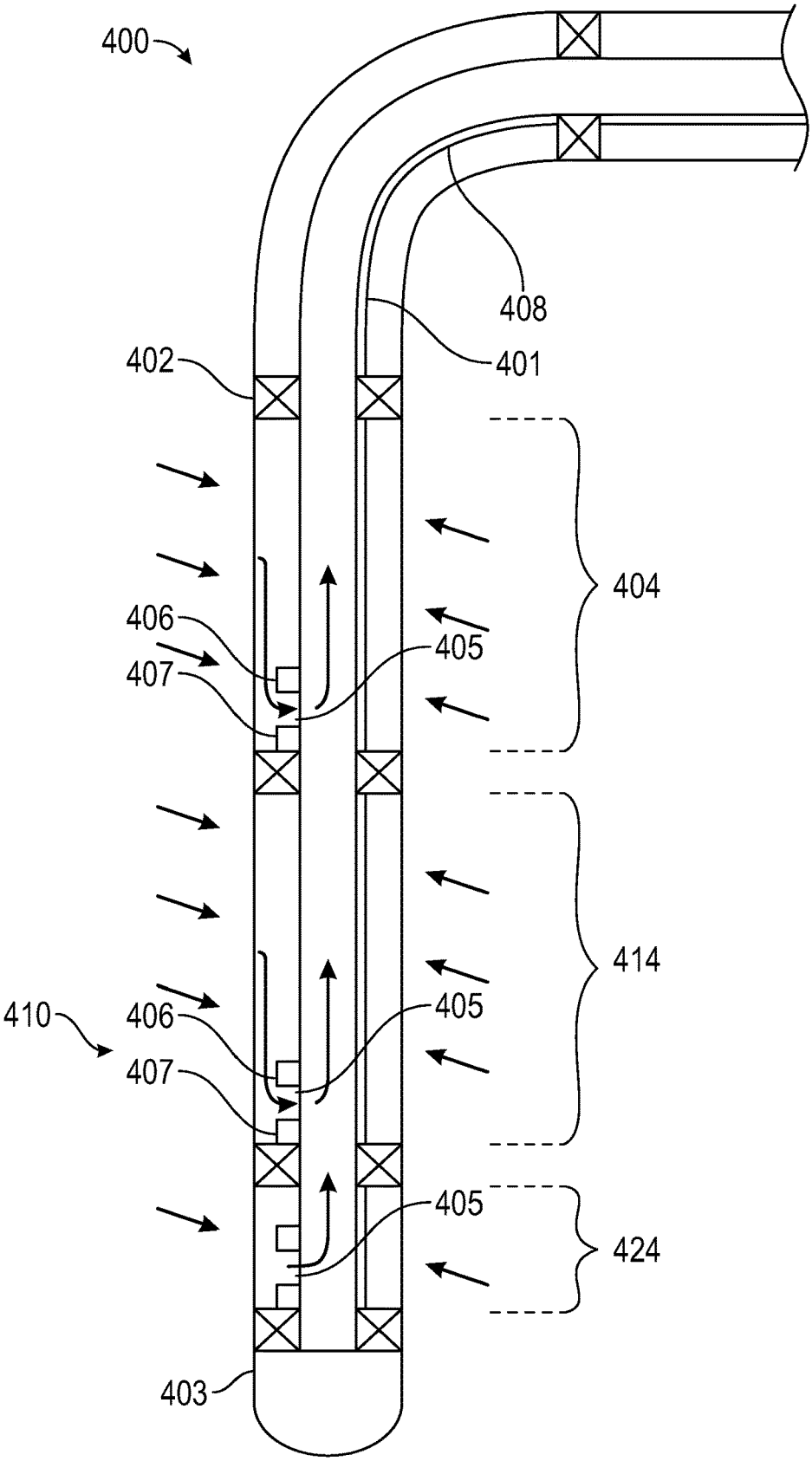
FIG. 4 depicts a system according to embodiments of the present disclosure having a tubing extending into a wellbore, three compartments isolated from one another by packers, an ultraviolet spectrometer installed in each compartment with an ultraviolet source and a photomultiplier detector.

For example, FIG. 4 shows an example of a monitoring and surveillance system according to embodiments of the present disclosure utilizing naturally occurring diamondoids to identify fluids within a well 400. However, similar systems as described herein may be used to detect injected and/or compartment diamondoids according to embodiments of the present disclosure. The system may include a liner or tubing 401 extending into a wellbore and a plurality of spaced apart packers 402 positioned between the tubing 401 and a wall of the wellbore 403. The packers 402 may expand around and contact both an outer surface of the tubing 401 and the wellbore wall 403 to seal the annular space formed around the tubing 401, thereby forming a plurality of compartments 404, 414, and 424, isolated from one another. Each compartment 404, 414, and 424 may have an opening 405 formed through the tubing 401 to allow fluid communication from the reservoir to surface equipment. For example, one or more inflow control devices, through-holes, and/or valved openings may be provided along the tubing 401 to form one or more openings 405 in each compartment 404, 414, 424.

The system may further include an ultraviolet spectrometer 410 installed in each compartment 404, 414, 424. Each ultraviolet spectrometer 410 may include an ultraviolet source 406 that excites targeted diamondoids (e.g., naturally occurring diamondoids produced from the reservoir or diamondoids injected downhole), a photomultiplier 407 that quantifies the excited diamondoids, and an electronic circuit that digitizes a response from the photomultiplier and sends the response to the surface of the well via an electric line 408. Different telemetry systems may be used to send data collected from the ultraviolet spectrometer(s) 410 to the surface of the well. For example, a dedicated circuit may be provided in communication with the ultraviolet spectrometer 410 to convert a captured absorption spectrum to a digital image, which may be sent to the surface of the well at selected intervals for further evaluation.

Prior to sending the system downhole, the ultraviolet spectrometer 410 may be calibrated at the surface of the well 400 by taking an absorption spectrum of the targeted diamondoids. Absorption spectra generated by the ultraviolet spectrometer 410 downhole during detection may then be compared with the calibration absorption spectrum. The quantity and type of diamondoids passing through the opening 405 may be calculated based on the ultraviolet spectra generated from the photomultiplier. In such manner, systems according to embodiments of the present disclosure may be used to monitor the amount and type of diamondoids attributed to different sections or zones of the well defined by the compartments 404, 414, 424, which may be correlated with types and amounts of fluids flowing through the compartments.

Methods according to embodiments of the present disclosure may include calculating the contribution of each zone of the reservoir (e.g., amount and types of fluids flowing from each zone of the reservoir) based on the quantity and types of naturally occurring diamondoids passing through each opening 405 in each compartment 404, 414, 424. In some embodiments, compartments 404, 414, 424 may be formed along a well around selected zones of the formation through which the well extends, e.g., by positioning the packers 402 around suspected boundaries of the selected zones in the formation and/or reservoir. For example, packers 402 may be positioned at one or more suspected changes in formation layers in a layered heterogeneous formation (e.g., based on previously conducted geological studies) to form compartments around different layers in the formation. As diamondoids pass through the opening(s) 405 in each compartment 404, 414, 424, the amount and types of passing diamondoids may be detected by the ultraviolet spectrometer 410 positioned around each opening 405, and the detection data may be sent uphole for processing. The detection data from the ultraviolet spectrometers 410 may be processed by associating the types of detected diamondoids with a fluid (e.g., a type of crude oil, amount of hydrocarbon cracking, biodegradation, a type of injected fluid, etc.) and/or by associating the amount and types of naturally occurring diamondoids detected with the compartment 404, 414, 424 (and thus zone of the well) from which the diamondoids came. For example, by detecting different diamondoid maturity ratios in crude oil, reservoir flow contribution may be quantified in layered heterogeneous reservoirs with distinct rock types containing different types of naturally occurring diamondoid (e.g., from a dual reservoir).

Further, by detecting and identifying diamondoids flowing through each compartment, sectional analysis of fluidly accessible parts of the formation via the compartments may be performed. For example, fluids capable of flowing through the formation and into a compartment may be analyzed downhole by the ultraviolet spectrometer(s) 410 associated with the compartment, which may identify and quantify the types and amount of naturally occurring diamondoids in the compartment fluids. Identification of the diamondoids flowing through the compartment may be used to identify the types of fluid (e.g., crude oils having different maturity ratios, type of injected fluid, etc.) accessible to the compartment, which may in turn provide information about the part of the formation the compartment is fluidly accessible to. By performing such analysis for multiple compartments 404, 414, 424 in a well, a larger understanding of the formation, as a whole, may be gathered, including, for example, types of hydrocarbons available for production (e.g., types of oil and gas), connectivity of the well with nearby injection wells, reservoir profiling, etc.

Figure 5:
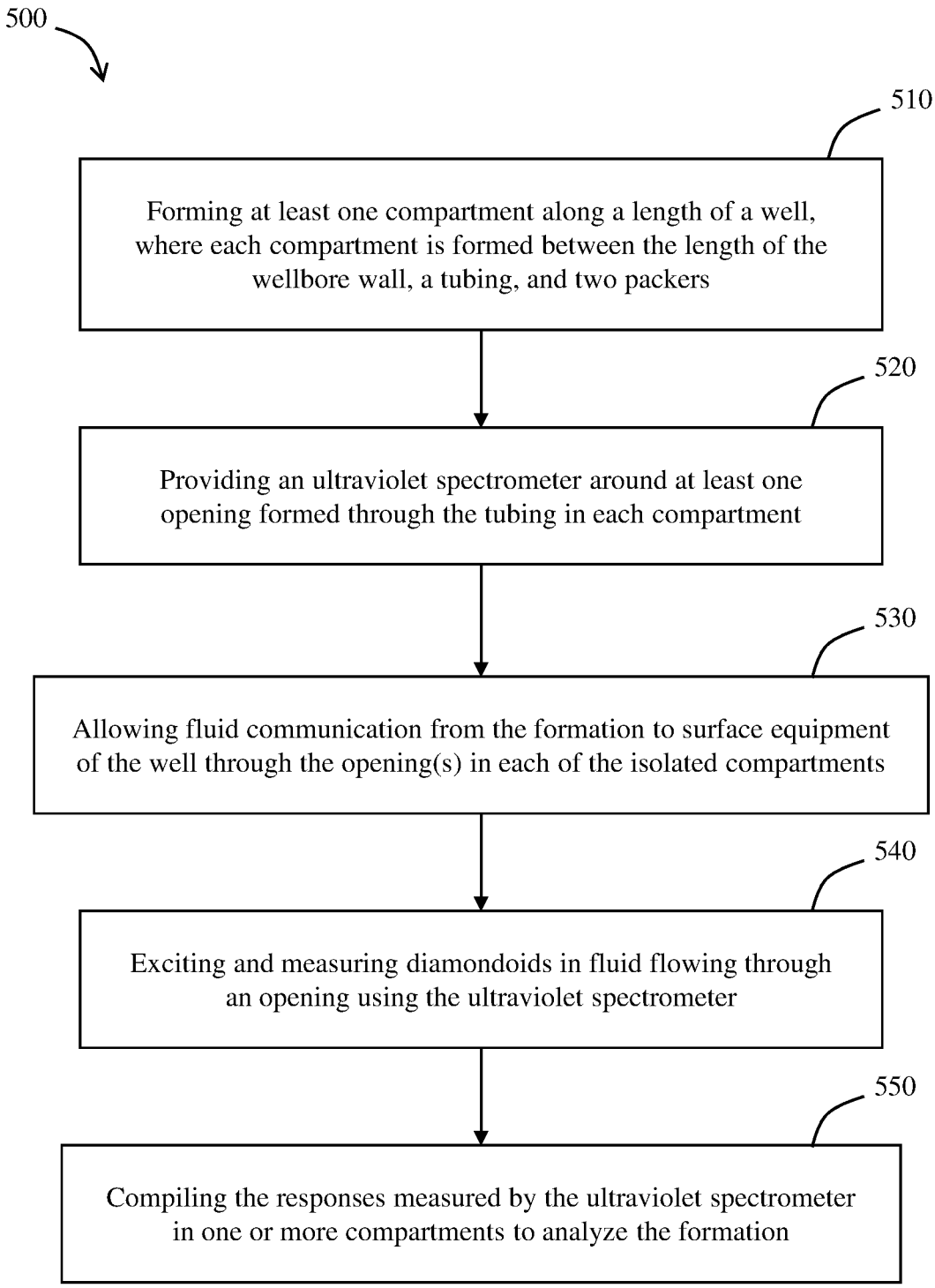
FIG. 5 shows a method of reservoir profiling according to embodiments of the present disclosure.

FIG. 5 shows an example of a method 500 according to embodiments of the present disclosure that may be used for analysis of a well based on downhole diamondoid detection. The method 500 may continuously monitor in real-time a fluid produced from a reservoir based on the diamondoid detection. As shown, the method 500 may include forming at least one compartment along a length of the well 510, where each compartment may be an annular space formed between the length of the wellbore wall, a tubing (e.g., a liner) extending through the well, and two packers positioned at axial ends of the compartment. In some embodiments, the length of a compartment may be chosen based on the formation characteristics along the wellbore wall. For example, a compartment length may be chosen to encompass a layer of a formation exposed along the wellbore wall that has substantially or generally similar rock characteristics (e.g., substantially uniform porosity or rock type). In some embodiments, compartment length may be selected according to a plan for draining the reservoir. According to embodiments of the present disclosure, compartments may be formed along different lengths of the well or along equal lengths of the well, and may range, for example, from less than 500 feet to more than 100 feet, e.g., between 100 feet and 2,000 feet. In some embodiments, compartments may be formed along a length ranging between 1/32 of the length of the well to 1/8 of the length of the well.

An ultraviolet spectrometer may be provided around at least one opening formed through the tubing in each compartment 520. According to some embodiments, an ultraviolet spectrometer may be attached to the tubing prior to sending the tubing downhole. For example, an ultraviolet spectrometer may be mounted (e.g., using screw(s), bracket (s), or other attachment mechanism) around an opening to the tubing, or an ultraviolet spectrometer may be mounted in a housing that may be either attached to the tubing or integrally formed with a component of the tubing. In some embodiments, an ultraviolet spectrometer may be provided on or adjacent to an inflow control device. In some embodiments, an ultraviolet spectrometer may be placed on a side mandrel or in a side pocket provided in the well completion architecture.

The method 500 may further include allowing fluid communication from the formation (e.g., fluid from a reservoir in the formation and/or fluid injected into the formation) to surface equipment of the well through the opening(s) in each of the isolated compartments 530. For example, in some embodiments, a valve to the opening(s) may be opened or closed to allow or prevent fluid from flowing therethrough. In some embodiments, a flow control device (e.g., an inflow control device or choke) may be provided at the opening(s) to allow fluid flow therethrough at a controlled rate. As fluid flows past the ultraviolet spectrometer, diamondoids in the fluid may be excited and measured by the ultraviolet spectrometer 540. The type of diamondoids detected may indicate the type of fluid carrying the diamondoids due to the solubility relationship of the diamondoid type with the fluid, as described above. The responses measured by the ultraviolet spectrometer in one or more compartments (indicating fluid flow through the compartments) may be compiled to analyze the formation 550.

Compartment Diamondoids

Some embodiments of the present disclosure are described above referencing detection of naturally occurring diamondoids in fluids flowing from a formation around a wellbore and into isolated compartments formed along the well in order to profile a formation and/or well. However, embodiments disclosed herein may similarly be used to detect compartment diamondoids artificially provided with production tubing in compartments formed around a well in order to profile a formation and/or well.

For example, one or more types of compartment diamondoids may be provided along a tubing prior to extending the tubing through the well, where the selected type(s) of diamondoids may be held along selected portions of the tubing to correspond with the locations of one or more compartments. In some embodiments, compartment diamondoids may be provided in one or more chambers formed around or in the tubing wall (e.g., by providing the diamondoids dispersed in a matrix such as rock chips that is held in the tubing chamber), in an inflow control device provided along the tubing, or as a coating on the tubing, or as a coating over a sand screen portion of the tubing. In some embodiments, a surface of the tubing may be coated with porous adsorbents, e.g., adsorbents such as alumina, activated carbon, polymers, and mesoporous silica, which may have a pore size, for example, of greater than 20 angstroms. Compartment diamondoids may then be preadsorbed onto the porous adsorbents. Further, in some embodiments, compartment diamondoids may be stored in a container, in an artificial rock, in rock chips, or in another type of matrix held in a chamber provided along the tubing.

Figure 6:
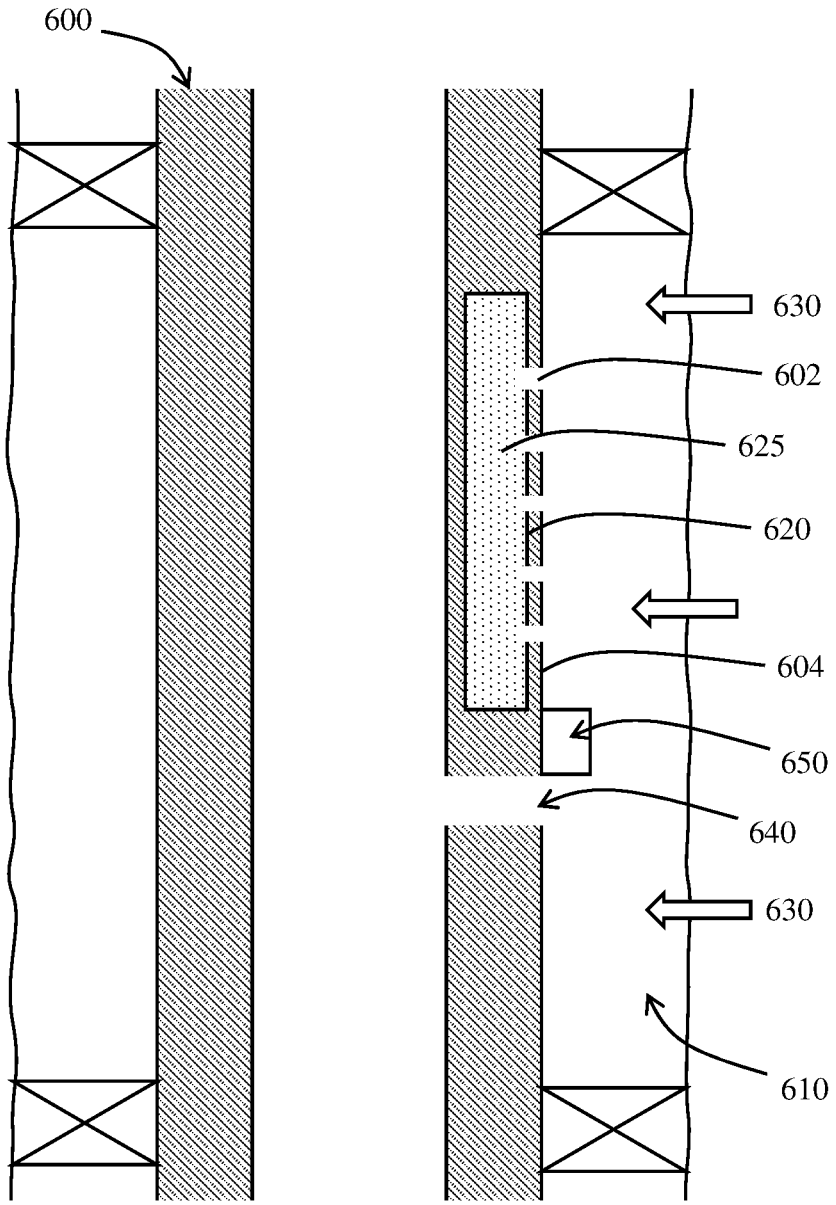
FIG. 6 shows a cross-sectional view of a system according to embodiments of the present disclosure having diamondoid chamber formed within a tubing extending into a wellbore.

FIG. 6 shows an example of a system according to embodiments of the present disclosure, where compartment diamondoids may be introduced within a chamber formed in a tubing (e.g., a liner) inside the well. As shown, a tubing 600 may be provided in a well and form part of a compartment 610. The tubing 600 may be a liner having at least one chamber 620 formed in the wall of the tubing 600, where the chamber 620 may be formed between an inner surface of the tubing and an outer surface 604 of the tubing 600. At least one type of compartment diamondoid 625 may be held within the chamber 620 (e.g., where the diamondoids may be provided with rock chips or other matrix material such as porous adsorbents), which may be in fluid communication with the compartment 610 through one or more orifices. For example, as shown in FIG. 6, orifices 602 may be formed as perforations through a perforated outer surface of the tubing 600 to fluidly connect the chamber 620 with the compartment 610. In some embodiments, an orifice may be pressure operated to open/close (e.g., using a valve), where an increase in pressure from fluid 630 flowing into the compartment 610 may open the orifice to allow fluid 630 to sweep up the compartment diamondoids 625. As fluid 630 flows through the compartment 610, the fluid 630 may carry the compartment diamondoids with it as the fluid flows through the compartment 610, out an opening 640 to the compartment 610, and up the tubing 600 to the surface of the well.

In embodiments having compartment diamondoids provided in a chamber 620 formed within the wall of a tubing 600, diamondoids may be loaded into the chamber 620 prior to installing the tubing 600 downhole. For example, compartment diamondoids 625 may be filled into the chamber 620 through one or more orifices 602, where the orifices may be closed or restricted after filling in order to transport the tubing 600 into position downhole. In some embodiments, compartment diamondoids may be provided in a chamber 620 formed within the wall of a tubing 600 having one or more axially slidable sleeves forming the outer surface of the tubing wall. In such embodiments, the sleeve may be slid in a first axial direction to open the chamber 620 and deposit compartment diamondoids, and the sleeve may be slid in an opposite axial direction to close the chamber 620. Once the tubing 600 is installed, the sleeve may be at least partially opened to allow fluid access to the compartment diamondoids.

Further, the embodiment shown in FIG. 6 includes an ultraviolet spectrometer 650 positioned in the compartment 610 for detecting the compartment diamondoids 625. The ultraviolet spectrometer 650 may be positioned on the outer surface 604 of the tubing, for example, around the opening 640 to the compartment or around an orifice 602 to the chamber 620. The ultraviolet spectrometer 650 may measure the compartment diamondoids 625 inside the tubing through a window resistant to high pressures and high temperatures typically found downhole.

Figure 7:
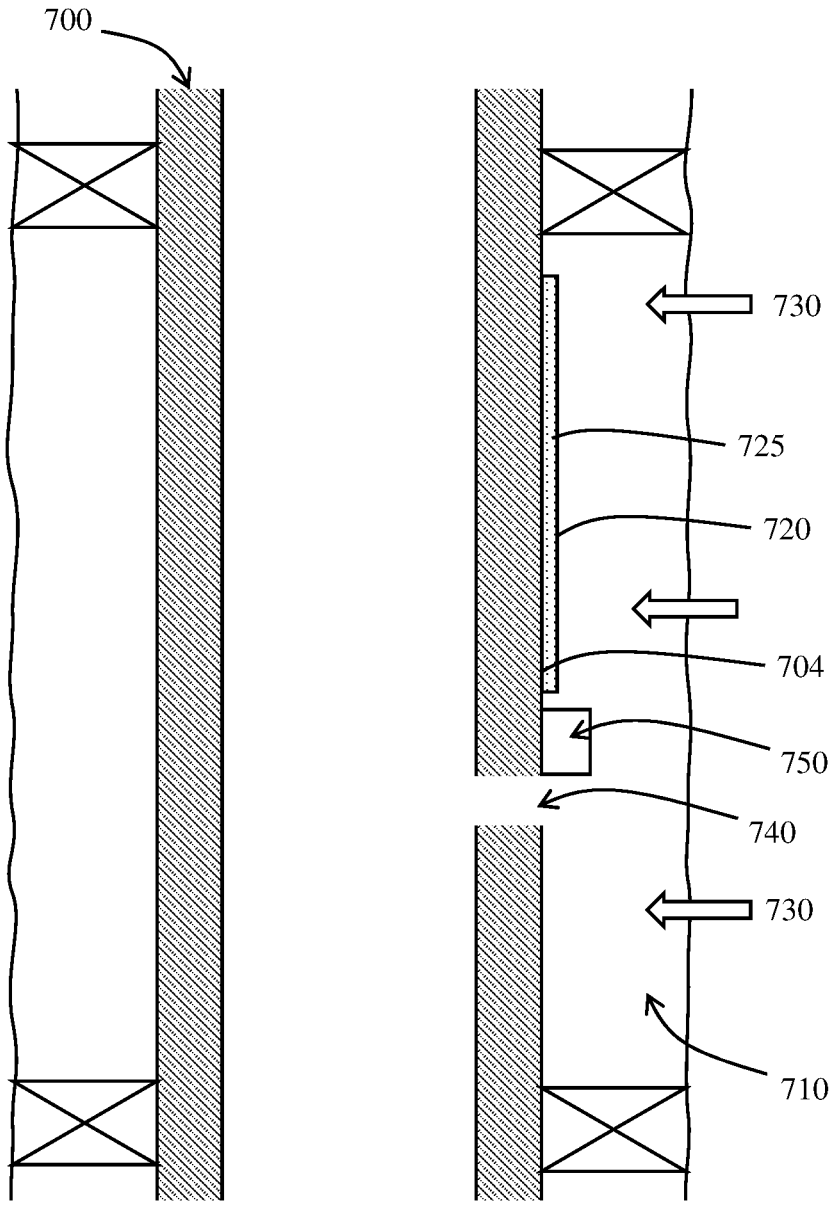
FIG. 7 shows a cross-sectional view of a system according to embodiments of the present disclosure having diamondoids provided on a coating of porous adsorbents along an inner wall of a compartment.

FIG. 7 shows another example of a system according to embodiments of the present disclosure, where compartment diamondoids may be introduced into porous adsorbents coated along a compartment inner wall (e.g., on a tubing inside the well). As shown, a tubing 700 may be provided in a well and form part of a compartment 710. The tubing 700 may have porous adsorbents 720 coated along an outer surface 704 of the tubing 700. In some embodiments, more than one compartment inner wall may be coated with porous adsorbents 720, for example, entirely or partially along the tubing 700 outer surface 704, along an outer surface of a housing for an ultraviolet spectrometer 750 positioned in the compartment 710, and other surfaces exposed to the interior of the compartment 710. The porous adsorbents may include, for example, alumina, activated carbon, polymers, mesoporous silica, and other adsorbents having a pore size greater than 20 angstroms. In some embodiments, the porous adsorbents 720 may be coated in a layer along a compartment inner wall having a thickness of greater than 10 nm. At least one type of compartment diamondoid 725 may be preadsorbed onto the porous adsorbents 720 prior to forming the compartment 710. As fluid 730 flows through the compartment 710, the fluid 730 may carry the compartment diamondoids with it as the fluid flows through the compartment 710, out an opening 740 to the compartment 710, and up the tubing 700 to the surface of the well. An ultraviolet spectrometer 750 may be positioned in the compartment 710 for detecting the compartment diamondoids 725 as they are flowed through the compartment 710.

According to some embodiments, by providing different types of compartment diamondoids in each compartment, ultraviolet spectrometers may not be needed at each compartment in order to correlate diamondoid detection with a source compartment. For example, a first type of compartment diamondoid may be provided in a first compartment, and different type(s) of compartment diamondoids may be provided in different compartment(s), where detection of the first type of compartment diamondoid by an ultraviolet spectrometer that is not positioned in the first compartment (e.g., by an ultraviolet spectrometer at the surface of the well and/or by an ultraviolet spectrometer on a downhole tool or any other relevant analytical equipment, such as Nuclear Magnetic Resonance spectrometer (NMR) or Gas Chromatography-Mass Spectrometer (GC-MS)) may indicate the fluid source as coming from the first compartment. In some embodiments, diamondoid detectors may be deployed as retrievable systems with wirelines or e-Coil (electrical line with coiled tubing) to temporarily monitor the diamondoids when needed to assess fluid movement in the reservoir. Data through retrievable systems may be transmitted in real-time to the surface from the sensors downhole that detect the diamondoids. Alternatively, diamondoids may be detected on surface using analytical equipment.

In some embodiments, a chamber may be provided around and attached to an inner surface or an outer surface of the tubing, where fluid may flow through the chamber to access compartment diamondoids stored therein. In some embodiments, a chamber may have diamondoids preadsorbed into porous adsorbents coated on one or more surfaces, where fluid flowing through the chamber may dissolve the coating to release the compartment diamondoids.

In some embodiments, diamondoids may be stored in a matrix, which may be injected into the formation surrounding the well using a perforating gun prior to installing the tubing in the well. For example, after diamondoids are injected into the formation around a well, the tubing may be installed, and compartments may be formed (e.g., by sealing spaced apart packers between the tubing and wellbore wall), where the injected diamondoids may be released into the compartments during production. Release of the injected diamondoids into the production fluid may be a function of the solubility of the matrix containing the injected diamondoids, the solubility of the diamondoids, the Reynolds number of the production fluid, and the flow rate of the production fluid flowing around the matrix.

Fluid Flow Management Based on Detected Diamondoids

According to embodiments of the present disclosure, diamondoid detection from individual compartments may be used to determine fluid flow properties, such as the type of fluid and amount of fluid, from each compartment. Fluid flow properties determined from one or more compartments along a well may be used for profiling the entire well. In some embodiments, fluid flow may be managed/controlled to provide a desired production from the well based on the fluid flow properties determined using diamondoid detection methods and systems disclosed herein.

For example, embodiments disclosed herein may include using compartment diamondoid detection to analyze fluid flow through the compartment. By providing a pre-selected type of compartment diamondoid in each compartment of a well (or injecting a pre-selected type of injected diamondoid into sections of the formation around different compartments), the detection of each type of diamondoid may be used to provide data about flow rates and fluid compositions flowing through each compartment. For example, detection of an amount of a first type of compartment diamondoid that was provided in a first compartment may indicate an amount of fluid flowing through the first compartment, whether or not naturally occurring diamondoids were present in the fluid flowing through the first compartment. In some embodiments, flow contribution for lateral or homogeneous formations may be monitored by providing different types of compartment diamondoids in different compartments (e.g., by providing different rocks having different diamondoids, by providing different dissolvable coatings of different diamondoids, or providing the different diamondoids in another type of matrix held within the compartments), where detection of the different types of compartment diamondoids may indicate production from the corresponding compartments. Compartment diamondoids and/or a matrix carrying compartment diamondoids may be selected to be soluble in a selected fluid type, e.g., in water or in gas condensates or in heavy oil, for example. The identification of the corresponding compartment diamondoid by an analytical equipment, whether downhole or at surface, may then indicate the type of fluid the corresponding compartment produces (e.g., water, oil, or gas).

In some embodiments, other types of diamondoids, including naturally occurring diamondoids and injection diamondoids, may be used to analyze fluid flow through one or more compartments in a well. For example, an amount and/or type of naturally occurring diamondoid detected in a compartment may indicate the amount and/or type of fluid being produced through the compartment. Likewise, an amount and/or type of injected diamondoid detected in a compartment may indicate the amount and/or type of fluid being produced through the compartment. Using such techniques to analyze fluid flow through each compartment formed in a well may allow for whole-well fluid analysis. Further, based on such analysis, individual compartments in a well may be controlled to produce certain amounts of the detected fluid flowing therethrough. For example, a first fluid type/amount detected in a first compartment (through detected diamondoids) may be controlled to either reduce the amount of first fluid or stop the first fluid flow through the first compartment by adjusting a valve(s) to the opening (s) of the first compartment accordingly.

Using diamondoids to identify inflow contributions to the well may provide a major advantage over downhole reservoir sampling wherein the changes of temperature and pressure between downhole sampling and surface analysis introduces erroneous phase changes to the sample. Further, when using conventional downhole sampling, the number of downhole fluid samples collected may be limited by the number of available bottles of the wireline sampling tool, and the differentiation between different fluid compartments is challenging in horizontal wells.

Figure 8:
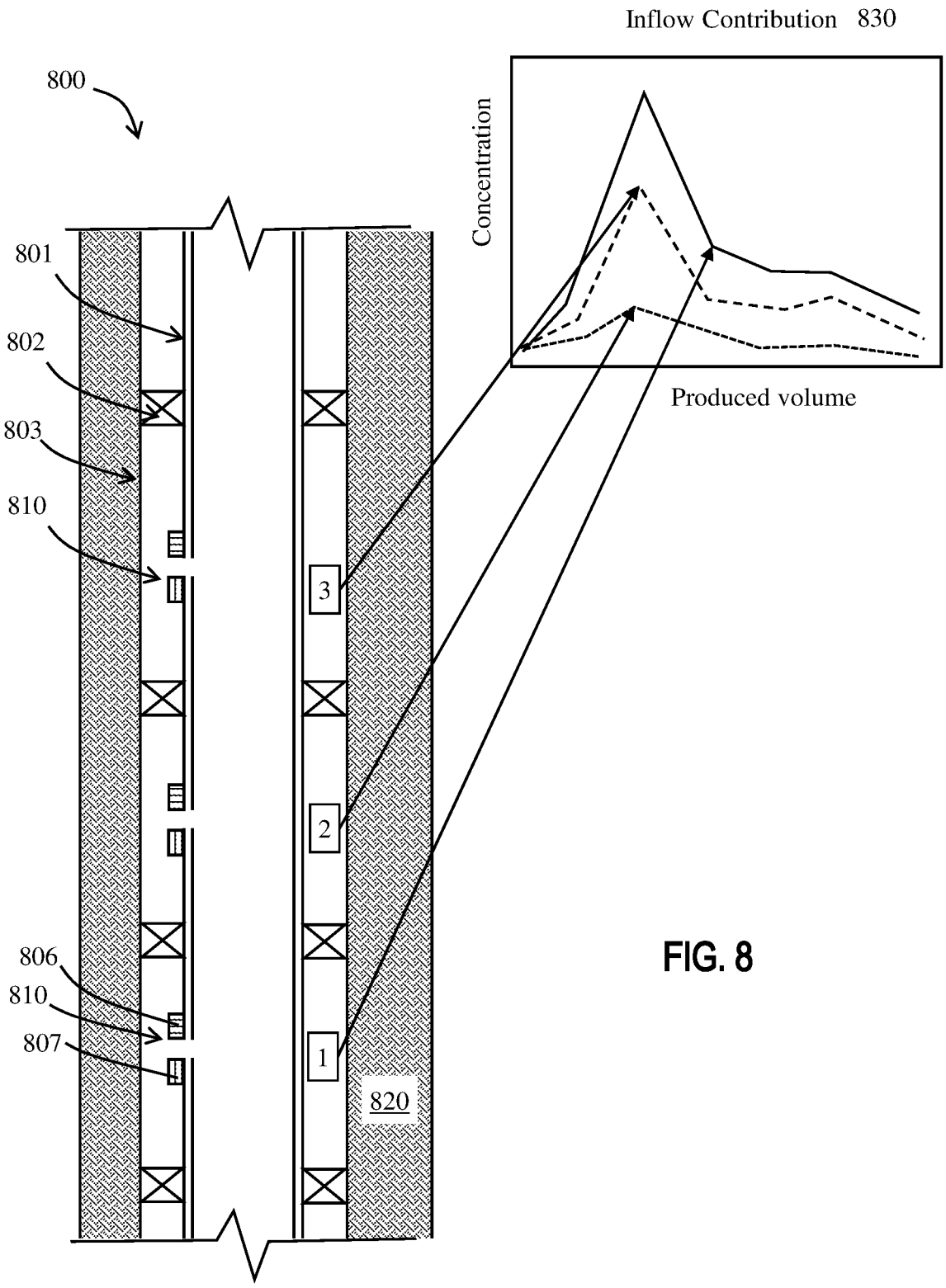
FIG. 8 shows a system for determining the contribution from different compartments in a well to reservoir production according to embodiments of the present disclosure.

FIG. 8 illustrates an example of a system for monitoring diamondoids detected from different compartments 1, 2, 3 formed along a well 800. Each compartment 1, 2, 3 is formed between a tubing 801 extending through the well 800, the wellbore wall 803, and spaced apart packers 802 sealing the annular space between the wellbore wall 803 and tubing 801. An ultraviolet spectrometer 810 including an ultraviolet source 806 and a photomultiplier 807 may be provided in each compartment to detect diamondoids. In other embodiments, such as when selected compartment diamondoids are provided in selected compartments to identify a fluid source from a compartment according to the type of compartment diamondoid detected, a diamondoid detection device (e.g., an ultraviolet spectrometer) may be provided in a location different from the compartment, e.g., at the surface of the well or in a downhole logging tool.

According to embodiments of the present disclosure, different types of diamondoids may be chosen and held within each compartment 1, 2, 3 prior to flowing fluid through the compartments. Different compartment diamondoid compositions may be held within each compartment, for example, by holding the compartment diamondoids in chambers formed in the wall of the tubing 801, by preadsorbing diamondoids into porous adsorbents coated along at least one surface in the compartment, by providing the diamondoids in a dissolvable coating that coats at least one surface in the compartment (e.g., coating an outer surface of the tubing), by holding the diamondoid compositions in chambers attached around an outer perimeter of the tubing 801, or by other mechanisms capable of exposing the diamondoid compositions to fluid flow within the compartments 1, 2, 3. For example, in some embodiments, compartment diamondoids may be provided in a matrix (e.g., in a rock matrix, in porous adsorbents, or other artificial matrix) that may be contained in a perforated-walled chamber formed around the tubing 801, where fluid may flow around and sweep up the diamondoids while flowing through the compartment.

In some embodiments, formation diamondoids may be provided through the formation surrounding the well (e.g., naturally occurring in the formation and/or injected into the formation through an injection well) in addition to or in the alternative to initially providing compartment diamondoids within the compartments 1, 2, 3. The compartment diamondoids may be chosen to be distinguishable from the formation diamondoids to avoid any interference of measurement.

As shown in FIG. 8, the flow contribution from compartment 1 may be associated with an amount of a type of diamondoids detected from an ultraviolet spectrometer 810 located in compartment 1. The ultraviolet source 806 of compartment 1 may be chosen to excite a specific type of diamondoid. The ultraviolet source of compartment 2 may be chosen to excite the same or a different type of diamondoid. Finally, the ultraviolet source of compartment 3 may be chosen to excite the same diamondoid type or a different diamondoid type from the ones in compartments 1 and 2. A baseline for the diamondoid signal may be acquired by running each compartment individually. For example, a valved opening from one compartment may be opened while the remaining compartments may have valved openings in a closed position to record a baseline for the opened compartment. The same process may be performed for each compartment to record a baseline for each compartment. Once the baseline is recorded for each compartment, all the valved openings may be opened, and data may be measured in each compartment (and optionally on the surface to confirm the results).

The graph shown in FIG. 8 is an example of the flow contribution determined from each compartment 1, 2, 3 to reservoir production, as determined from the measurement of diamondoids from each compartment. As shown, different compartments may provide different amounts of flow contribution, which may indicate different characteristics of the formation surrounding each compartment that may be favorable or unfavorable to production. For example, in the embodiment shown, compartment diamondoids may be detected by the ultraviolet spectrometer associated with each compartment 1, 2, 3 during production flow. Based on the amount of compartment diamondoids detected from each compartment 1, 2, 3, the amount of fluid flowing through each compartment 1, 2, 3 may be estimated. From the determined amount of fluid flow through each compartment 1, 2, 3, relative amounts of fluid contribution to the overall fluid production may be calculated.

The production run in FIG. 8 shows compartment 1 contributing about 60 percent of the fluid production, compartment 2 contributing about 10 percent of the fluid production, and compartment 3 contributing about 30 percent of the fluid production. This may indicate that the formation 820 surrounding compartment 1 may have relatively higher connectivity with a reservoir compared with the formation surrounding compartments 2 and 3. Differences in inflow contribution between different compartments 1, 2, 3 may also indicate changes in formation characteristics along different lengths of the well, e.g., a layered heterogeneous formation.

Methods and systems according to embodiments of the present disclosure may also be used for the detection of a change of fluid produced by the reservoir. As mentioned above, diamondoids and their matrix may be chosen based on their solubility in a fluid flowing through the formation into the well, e.g., gas condensate or heavier crude oil, for instance. Based on their affinity to a particular fluid, diamondoids may be used to detect the evolution of the produced fluid in each compartment zone, and a real-time downhole production profile may be acquired. An operator may decide to shut down the production of a specific zone based on this information.

For example, measurements taken by one or more ultraviolet spectrometers may be used to determine reservoir connectivity and reservoir profiling based on the response in each compartment. In some embodiments, a ratio of different diamondoid types may be measured by the ultraviolet spectrometers, which may be used to assess reservoir connectivity, to determine a flow contribution from each compartment, and/or to determine a flow rate of the fluid produced from each compartment. For example, a first amount of diamondoids may be detected from an ultraviolet spectrometer in a first compartment, and a second amount of diamondoids may be detected from an ultraviolet spectrometer in a second compartment, where the higher of the first and second amounts of diamondoids may indicate a higher production from the formation around the corresponding first or second compartment.

Further, if detected diamondoids and their ratios are different in different compartments, this may indicate a different source of hydrocarbons in fluid communication with the different compartments (e.g., different maturity levels of hydrocarbons may be in different zones of the formation). When a producing well is determined to have multiple sources of hydrocarbons from well analysis using diamondoid detection methods disclosed herein, an operator may choose to produce one type of hydrocarbons and shut down the production of the other for economical and/or environmental reasons. For instance, if a first zone in the formation produces diamondoid-sulfur derivatives (indicating a sour environment) while a second zone in the formation does not show indications of sour production, an operator may want to shut down fluid connection to the first zone (e.g., by closing the opening(s) to compartment(s) fluidly connected to the first zone) to prevent $H_2S$ related issues such as environmental health risks, corrosion of the production tubing, added cost associated with $H_2S$ treatment facility, etc.

In another example, when water breakthrough to one or more compartments is detected, an operator may close the corresponding production zone by closing the openings (e.g., closing valves to the openings) in the compartment(s) in which water was detected. The type of combination of diamondoids and matrix used (e.g., the type of compartment diamondoids provided in a tubing) may be selected as a function of their solubility in crude oil as compared to their solubility in water to determine water breakthrough from the production zone. For example, if water breakthrough is coming from a first compartment, fluid having a relatively lower oil:water ratio may flow through the first compartment, and thus, a decreased amount of diamondoids may be dissolved in the relatively decreased amount of oil coming through the first compartment. This decrease in the amount of diamondoids from the first compartment may indicate water breakthrough in the first compartment.

Further, the difference of solubility of different diamondoids in downhole fluids may allow even more granularity with the detection of gases, light crude, and heavy crude oil when compared with conventional downhole analysis tools. For instance, the detection of different diamondoids in different fluid gives the possibility to an operator to distinguish locations of gas condensate and heavy oil production and optimize the production of gas condensate and minimize the production of heavy oil or vice versa.

In some embodiments, a system and/or method to calculate the contribution of each compartment zone of a reservoir may be integrated into an online advisory (e.g., an Ifield) system or other intelligent software that can monitor a fluid's movement within the reservoir and adjust flow control devices (e.g., inflow control valves or downhole choke valves) accordingly. For example, referring back to FIG. 8, inflow contributions 830 may be stored in a computer system, which may be accessible online or offline on the computer network. The computer system may include software instructions (e.g., stored on one or more computer readable storage devices) for quantifying flow contributions from each compartment 1, 2, 3 being monitored. Additionally, the computer system may further include software instructions for performing one or more recommended actions in a production process based on the determined flow contributions (e.g., shutting down one or more compartments based on the type and/or amount of fluid detected therefrom, giving recommendations on when logging the well is needed rather than relying on rigid, non-scientific based logging frequency, shutting down injection from an injection well, and/or others). The system may also provide downhole production profiling for the different phases (oil, water, and gas) and assess surface and subsurface integrity.

Flow Rate Calculation Based on Diamondoid Detection

In some embodiments, flow rates of fluid from each compartment zone may be calculated based on the measurement of the quantity and type of diamondoids detected from each compartment and pressure in the compartments. For example, in some embodiments, the fluid pressure in each compartment may be measured in addition to detecting diamondoids flowing through the compartments. In some embodiments, the fluid pressure in a compartment may be measured using one or more downhole pressure sensors. In some embodiments, one or more pressure relief valves may be provided to openings to the compartments, where the opening valves may open upon a minimum pressure build up on the inlet side of the valve. In such embodiments, when pressure in a compartment builds to the minimum pressure due to inflow of fluid from the surrounding formation, the valve to the compartment opening may open, thereby allowing the fluid in the compartment to flow out of the compartment and up through the tubing. When the fluid flows through the open opening, diamondoids from the open compartment may be detected. The combination of the detected type and amount of diamondoids and the minimum pressure of the fluid (as indicated from the opening valve being opened and fluid flow therethrough) may be used to determine a flow rate of a fluid flowing from a compartment zone in the well.

By providing a pre-selected type of compartment diamondoids in each compartment (or injecting a pre-selected type of injected diamondoid into sections of the formation around different compartments), the detection of each type of diamondoid may be used to provide data about flow rates and fluid compositions flowing through each compartment. For example, detection of an amount of a first type of compartment diamondoids that was provided in a first compartment may indicate a flow rate of fluid flowing through the first compartment whether or not naturally occurring diamondoids were present in the fluid flowing through the first compartment. In some embodiments, flow contribution for lateral or homogeneous formations may be monitored by providing different types of compartment diamondoids in different compartments (e.g., by providing different rocks having different diamondoids, by providing different dissolvable coatings of different diamondoids, or providing the different diamondoids in another type of matrix held within the compartments).

Using Diamondoids to Analyze Reservoir Connectivity

According to embodiments of the present disclosure, methods and systems for diamondoid detection disclosed herein may also be used to analyze reservoir connectivity using injection wells. For example, one or more embodiments may include injecting one or more types of deuterated diamondoids in one or more injection wells and monitoring the ultraviolet spectra in each compartment of a production well to determine reservoir connectivity between the injection well(s) and the production well. As the injected diamondoids are detected by a first ultraviolet spectrometer of one of the compartments, connectivity between the injection wells and the compartment may be established. If several injection wells and injected diamondoids are used, a detailed reservoirs mapping may be established to optimize reservoir sweep.

Figure 9:
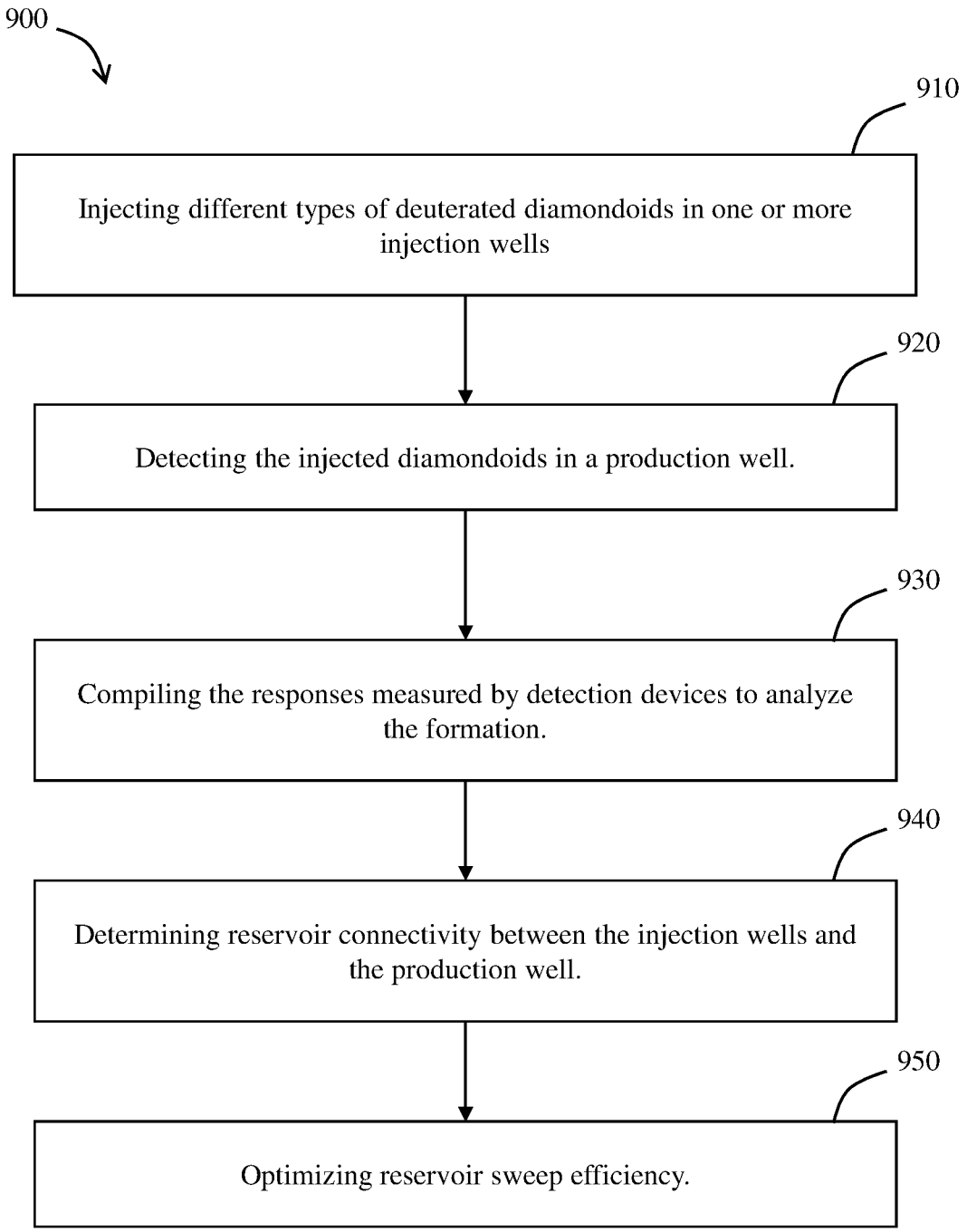
FIG. 9 shows a method of determining reservoir connectivity between injection wells and a production well according to embodiments of the present disclosure.

For example, FIG. 9 shows a method 900 using injection diamondoids to determine reservoir connectivity according to embodiments of the present disclosure. The method 900 includes injecting one or more types of deuterated diamondoids in one or more injection wells 910. For example, different deuterated diamondoids may include deuterated diamondoids with different mass to charge (m/z) ratios. The deuterated diamondoids may be detected from a production well 920 (e.g., in a downhole location in the production well or at a surface location of the production well). For example, in some embodiments, deuterated diamondoids may be detected using diamondoid detection devices positioned in compartments formed along the production well, as described above. In some embodiments, deuterated diamondoids may be detected from the production well using surface analytical equipment at the surface of the production well. In some embodiments, deuterated diamondoids may be detected from the production well using one or more retrievable systems (e.g., downhole analyzer sent downhole on a coiled tubing or wireline).

Diamondoid detection data may be compiled from detection devices (e.g., ultraviolet spectrometers, NMR, GC-MS, or any other relevant analytical equipment) used to detect the deuterated diamondoids, e.g., at the surface of the production well and/or downhole, which may be used to analyze the formation around the production well 930.

Formation analysis may include, for example, determining reservoir connectivity between one or more injection wells and the production well based on relative detected amounts of injected deuterated diamondoids injected from different injection wells 940. For example, a first type of deuterated diamondoid may be injected into a first injection well, and a second type of deuterated diamondoid may be injected into a second injection well. The production well may be monitored using diamondoid detection processes described herein to detect an amount of the first type and second type of diamondoids, where higher detection rates of the first or second type of deuterated diamondoid may indicate greater reservoir connectivity between the first or second injection well and the production well. Based on determined reservoir connectivity, reservoir sweep efficiency may be optimized 950, e.g., by sweeping through an injection well determined to have greatest connectivity to the production well.

Another embodiment may include a system and method that can distinguish and quantify between injected carbon dioxide ($CO_2$) and resident or in-situ $CO_2$. In certain situations, such as $CO_2$ underground storage and $CO_2$-Enhanced Oil Recovery or $CO_2$-EOR, it may be difficult to distinguish between the injected $CO_2$ and the in-situ $CO_2$ released from the produced oil. According to embodiments of the present disclosure, the differentiation between $CO_2$-EOR and in-situ $CO_2$ may be accomplished by distinguishing different diamondoids brought in the production line from the injected $CO_2$.

For example, a selected type of deuterated diamondoids may be dissolved in supercritical $CO_2$-EOR. The deuterated diamondoid tracers may be injected along with the $CO_2$-EOR into injection well(s). Analytical equipment, such as NMR equipment, may monitor and quantify the deuterated diamondoids downhole or at the surface of the production well to determine if $CO_2$-EOR from the injection well(s) is flowing into the production well. In such manner, reservoir connectivity between the injection well(s) and the production well may be established. In some embodiments, an online advisory system may adjust flow control devices (e.g., inflow control valves or downhole choke valves) of each compartment along the tubing of the production well as water, oil, and gas are produced. Further, the flow rate of fluid through each compartment zone may be calculated based on the measurement of the deuterated diamondoid tracers injected from one or more injection wells.

Using Diamondoids for Leak Detection

In some embodiments, diamondoids may be used as tracers to determine carbon dioxide leaks from $CO_2$ sequestration reservoirs or repositories. Diamondoids may be a preferred tracer due to its high thermal stability. When anthropogenic carbon dioxide is injected into $CO_2$ repositories, deuterated diamondoids may be injected with the $CO_2$, and potential leaks may be monitored by continuous analysis of any liquid (e.g., water and oil) produced in the vicinity of the $CO_2$ repository, including, for example, from an aquifer or stagnant water sources such as lake. Alternatively, liquid surrounding $CO_2$ repositories may be sampled and analyzed in a laboratory setting to detect and identify the artificially created deuterated diamondoids. This analysis may be performed, for example, using NMR equipment located at the surface of the well.

Another embodiment may include the use of the deuterated diamondoids to assess pipeline integrity. In such embodiments, deuterated diamondoids may be injected either in crude oil (or other produced fluid) downhole or at the surface, and potential leaks in tubing transporting the produced fluid may be monitored by tracking in real-time any deuterated diamondoids in the surrounding of the tubing. Alternatively, any liquid surrounding a tubing transporting a produced fluid may be sampled and analyzed in a laboratory setting to detect any release of crude oil and its associated deuterated diamondoid. For instance, naturally occurring diamondoids may be detected when a leak occurs in a pipeline transporting crude oil offshore. However, a higher sensitivity of leak detection equipment may be needed for a lower concentration of leaking fluid, which may be achieved when deuterated diamondoids are used. Thus, an environmental alert may be triggered much earlier for detected leaks using deuterated diamondoids, and the environmental damage due to a spill may be minimized.

While the scope of the composition and method will be described with several embodiments, it is understood that one of ordinary skill in the relevant art will appreciate that many examples, variations and alterations to the composition and methods described here are within the scope and spirit of the disclosure. Accordingly, the embodiments described are set forth without any loss of generality, and without imposing limitations, on the disclosure. Those of skill in the art understand that the scope includes all possible combinations and uses of particular features described in the specifications.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A downhole monitoring system for continuously measuring in real-time a fluid produced from a reservoir, comprising:

a tubing extending into a wellbore;

a plurality of spaced apart packers forming annular seals between the tubing and a wall of the wellbore;

a plurality of isolated compartments formed between the spaced apart packers, each compartment comprising an opening in the tubing to allow fluid communication from the reservoir to surface equipment; and an ultraviolet spectrometer installed in each compartment, each ultraviolet spectrometer comprising:

an ultra-violet source that excites diamondoids;

a photomultiplier to quantify the excited diamondoids; and an electronic circuit that digitizes a response from the photomultiplier and sends the response to the surface of the wellbore.

2. The system of claim 1, further comprising a diamondoid source and a carbon dioxide source located at a surface of an injection well.

3. The system of claim 1, wherein the response is sent to the surface using a telemetry system.

4. The system of claim 1, wherein the tubing comprises at least one chamber in each isolated compartment, the at least one chamber holding a matrix having diamondoids.

5. The system of claim 4, wherein the at least one chamber is formed inside a wall of the tubing in each isolated compartment, and wherein at least one orifice fluidly connects the at least one chamber to the compartment.

6. The system of claim 4, wherein the matrix has diamondoids with different solubilities in each isolated compartment.

7. The system of claim 1, wherein at least a portion of the tubing is coated with porous adsorbents having diamondoids preadsorbed onto the porous adsorbents.

8. The system of claim 7, wherein the porous adsorbent coating comprises different types of diamondoids having different solubilities in each of the isolated compartments.

9. A method for continuously monitoring and in real-time a fluid produced from a reservoir, comprising:

allowing fluid communication from the reservoir to surface equipment through an opening in a plurality of isolated compartments formed along a tubing extended into a wellbore;

exciting diamondoids passing by an ultraviolet source in the plurality of isolated compartments;

measuring the excited diamondoids in the plurality of isolated compartments;

compiling the measurements of the excited diamondoids in each compartment; and determining reservoir connectivity and reservoir profiling based on the response in each compartment.

10. The method of claim 9, comprising measuring a ratio of different diamondoid types to assess reservoirs connectivity.

11. The method of claim 9, comprising measuring a ratio of different diamondoid types to determine a flow contribution from each compartment.

12. The method of claim 11, further comprising altering a flow rate of the fluid produced from at least one of the compartments based on the determined flow contribution.

13. The method of claim 9, comprising injecting one or more types of deuterated diamondoids in injection wells and monitoring the ultraviolet spectra in each compartment to determine reservoir connectivity.

14. The method of claim 9, wherein the diamondoids are provided from a coating of porous adsorbents having the diamondoids preadsorbed onto the porous adsorbents, and wherein the coating of porous adsorbents coats at least one surface of the tubing.

15. The method of claim 9, wherein the diamondoids are provided in a chamber formed inside a wall of the tubing.

16. The method of claim 9, comprising injecting one or more types of deuterated diamondoids in a production well to detect leaks of a tubing extending through the production well.

17. The method of claim 9, wherein different deuterated diamondoids with different mass to charge (m/z) ratio are injected in different injection wells to identify reservoirs connectivity.

* * * * *